US006220026B1

(12) United States Patent
Ritter

(10) Patent No.: US 6,220,026 B1
(45) Date of Patent: Apr. 24, 2001

(54) ACTIVE CONTROL SYSTEM

(75) Inventor: Andreas Ritter, Hilgert (DE)

(73) Assignee: Stabilus GmbH (DE)

( * ) Notice: Subject to any disclaimer, the term of this patent is extended or adjusted under 35 U.S.C. 154(b) by 0 days.

(21) Appl. No.: 09/151,361

(22) Filed: Sep. 10, 1998

(30) Foreign Application Priority Data

Sep. 11, 1997 (DE) ..... 197 40 029

(51) Int. Cl.[7] ..... F15B 11/15

(52) U.S. Cl. ..... 60/406; 60/481; 91/452; 91/453

(58) Field of Search ..... 60/403, 406, 481; 91/452, 453; 296/146.4, 146.8

(56) References Cited

U.S. PATENT DOCUMENTS 3,113,490 * 12/1963 Weaver ..... 92/128
4,250,794 * 2/1981 Haak et al. ..... 91/453
4,523,513 6/1985 Gudat et al. .
5,417,011 5/1995 Keszthelyi .
5,921,604 * 7/1999 Yu et al. ..... 296/146.4

FOREIGN PATENT DOCUMENTS 91 10 208 U 2/1993 (DE) .
2 203 486 10/1988 (GB) .
5065782 3/1993 (JP) .

* cited by examiner

*Primary Examiner*—F. Daniel Lopez
(74) *Attorney, Agent, or Firm*—Baker Botts L.L.P.

(57) ABSTRACT

Active control system for a movable member, in particular a tailgate or door, includes a pump unit which is connected by at least one fluid connecting line to a piston-cylinder unit. The control system has an on-off valve through which the direction of motion of the piston-cylinder unit is controlled. A pressure-limiting valve is operable, in emergency conditions, to permit a displacement motion of the piston rod of the piston-cylinder unit by opening a connection to the working chamber of the piston-cylinder unit.

6 Claims, 3 Drawing Sheets

ACTIVE CONTROL SYSTEM

BACKGROUND OF THE INVENTION

1. Field of the Invention

The present invention relates to an active control system of the type including a fluid-operated piston-cylinder unit for moving a movable member, wherein provision is made for opening a fluid connection to the unit in emergency conditions to permit axial displacement of the piston rod relative to the cylinder.

2. The Prior Art

FIG. 7 of DE 42 24 132 discloses an active door-locking system that has a piston-cylinder unit which is connected by connecting lines to a pump unit. An on-off valve permits regulation of the flow of pressure medium into a working chamber of the piston-cylinder unit. Such a system allows a door or tailgate motion in a motor vehicle, for example, to be performed very conveniently by operation of the piston-cylinder unit.

In the case of such active control systems, it should be considered that fingers or objects may possibly be pinched when, for example, a vehicle is being loaded. Physical harm to humans or damage to the goods loaded would be the unfortunate consequence.

In addition, the supply of energy may be interrupted, so that the control system is no longer capable of performing the control motion automatically. In such circumstances, the possibility that the door or tailgate cannot be opened must be avoided, because otherwise one could be trapped in the vehicle.

SUMMARY OF THE INVENTION

The object of the present invention is to provide measures by which the above-described problems in the prior art can be eliminated.

According to the invention, this object is accomplished in that the control system is provided with a pressure-limiting valve which, in emergency operation, opens to permit a displacement motion of the piston rod. The piston rod can be initially displaced by manual force, so as to release the pressure-limiting valve and permit free displacement of the piston rod. A condition in which the door cannot be opened or closed is thereby avoided.

An additional part of the object is accomplished in that the pressure-limiting valve is connected controlwise with the on-off valve, and the on-off valve, in the event of unduly increased pressure in the piston-cylinder unit resulting from a displacement motion of the piston rod, switches to the on position, at which the piston rod, preloaded by a spring force, carries out an opposite displacement motion. Thus, even without additional manual force or pump operation, the piston-cylinder unit is moved in the opposite direction, thereby providing protection not only against pinching, but also advantageously a release motion. Controlwise, this means that a limit switch for example recognizes the switch position of the pressure-limiting valve, and transmits this information to the on-off valve electrically, pneumatically or hydraulically as a control signal.

In order to reduce the manual force required in emergency operation to a minimum and at the same time ensure reliable normal operation, the pressure-limiting valve has two pressure threshold values at which it will be moved to and held in the open position. The two pressure threshold values result from the provision of two pressurized surfaces of unlike size on the pressure-limiting valve piston.

In order to obtain as simple as possible a control system, the piston-cylinder unit is preferably designed as a single-acting hydraulic cylinder.

In order to prevent a vacuum from occurring in the piston-cylinder unit under unfavorable operating conditions, the working chamber of the piston-cylinder unit is preferably connected via a check valve with a reservoir which releases a flow of fluid medium from the reservoir to the working chamber.

To obtain as low as possible an input of energy, a passive energy accumulator is connected in parallel with the active control system. Especially in emergency operation, the advantageous use of the energy accumulator results in distinctly reduced manual force being required.

It has been shown to be particularly advantageous if the passive energy accumulator is a pneumatic spring.

BRIEF DESCRIPTION OF THE DRAWINGS

A preferred embodiment of the invention is described below by reference to the accompanying drawings, in which.

DESCRIPTION OF A PREFERRED EMBODIMENT

Figure 1:
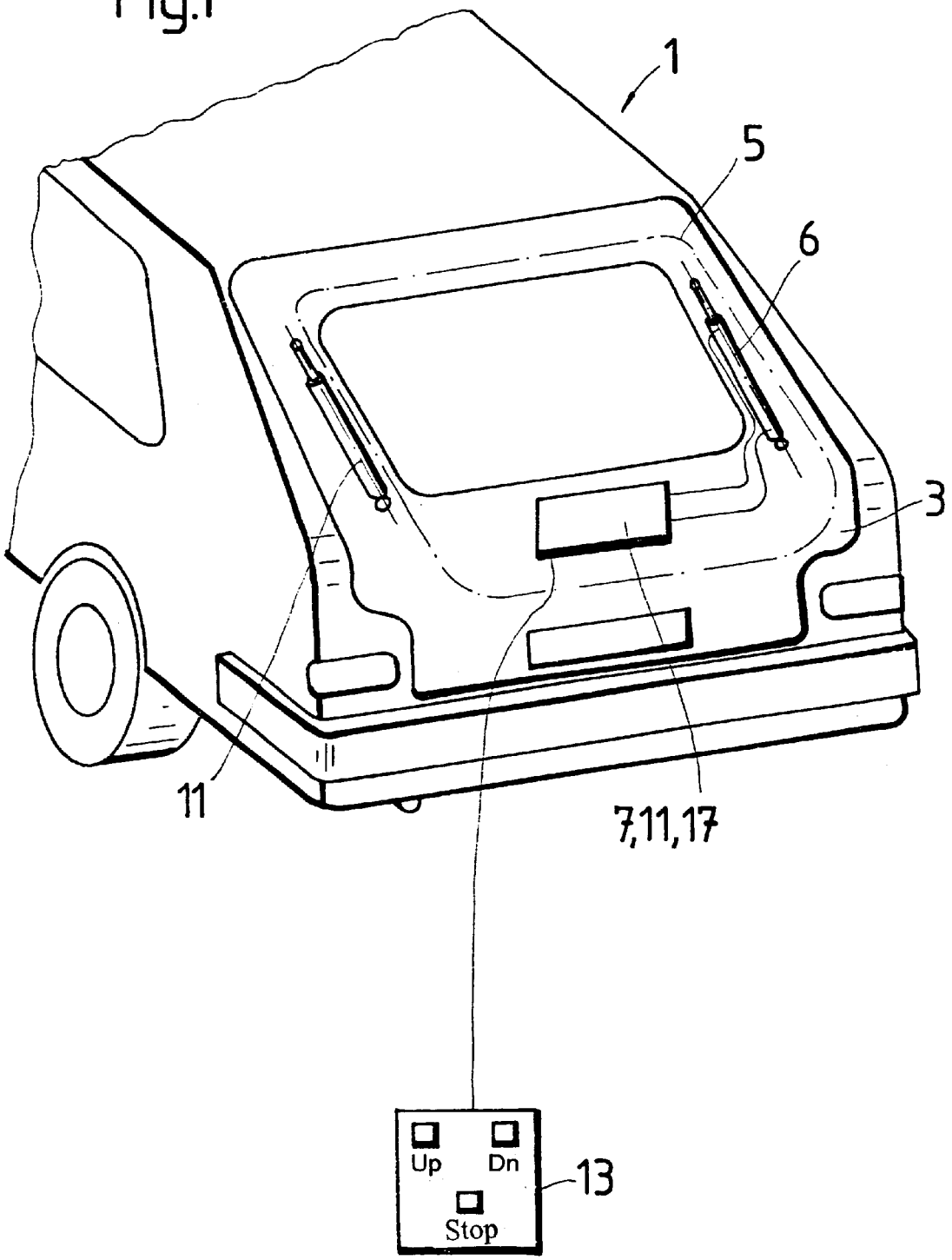
FIG. 1 shows the mounting of the active control system in connection with a vehicle tailgate.

FIG. 1 shows a partial view of a motor vehicle 1 with a tailgate 3, which may be opened as desired through operation of an active control system indicated schematically at 5. The active control system includes a piston-cylinder unit designed as a hydraulic operator 6, which is connected by fluid connecting elements with a pump unit 7 (see FIG. 2). In addition, an accumulator 9 and an on-off valve 11 are included. The control system 5 may be controlled by an actuating means 13. The actuating means has the switch positions "Up" and "Down" for motion and "Stop" for blocking of the hydraulic operator 6. A pneumatic spring 15, which may be conventional, is connected to operate in parallel with the active control system 5. A suitable pneumatic spring is disclosed for example in DE 29 50 888.

Figure 2:
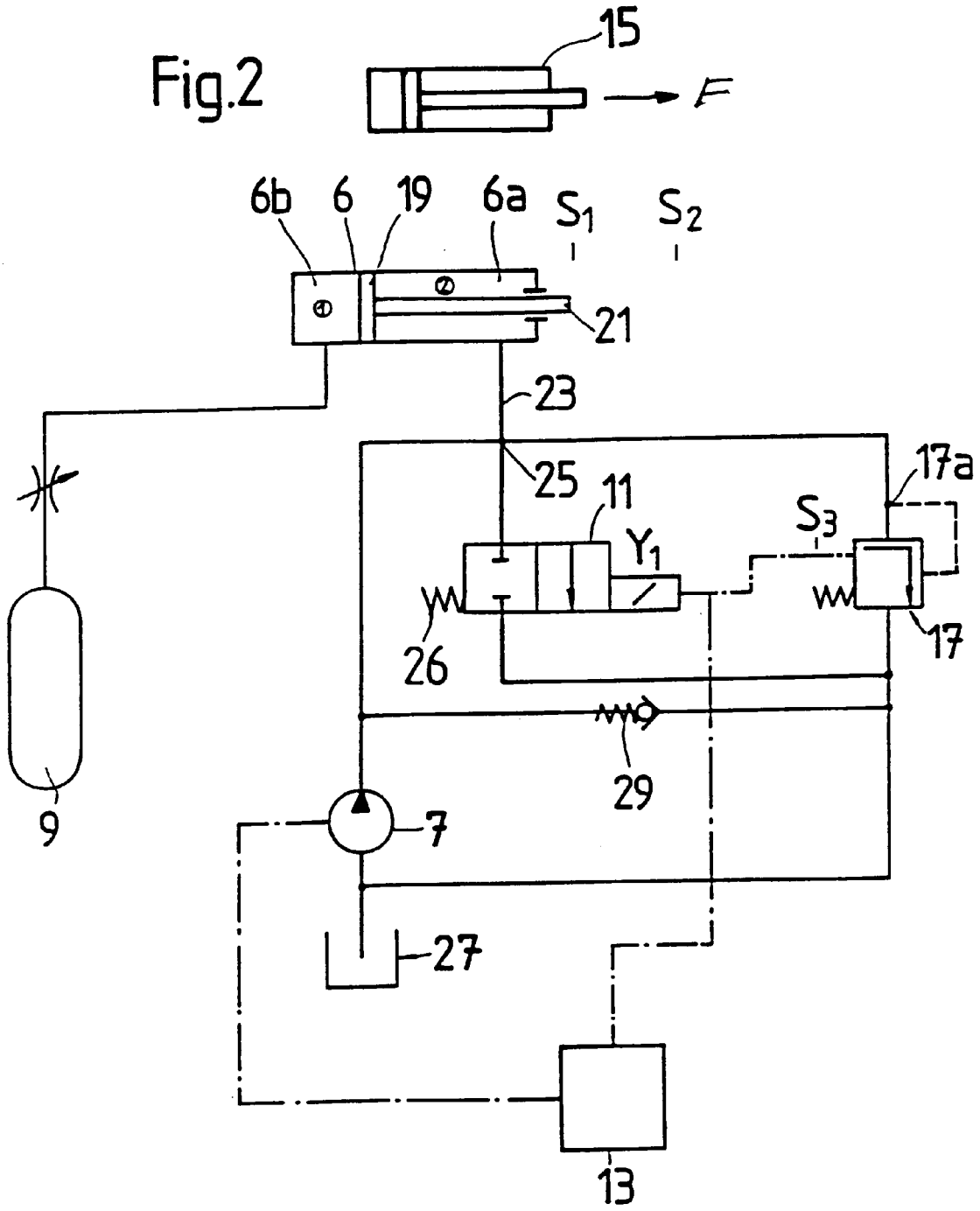
FIG. 2 is a circuit diagram of the control system.

Referring to FIG. 2, the hydraulic operator 6 and the pneumatic spring 15 act in tandem to provide a force F that lifts the tailgate from a closed position S1 to an open position S2 in one state of the control system, as described below. The pump 7 supplies fluid to the hydraulic operator 6 to close the tailgate against the force F in another state of the control system.

In addition to the components mentioned in relation to FIG. 1, the active control system includes a pressure-limiting valve 17. The hydraulic operator 6 is divided into two working chambers **6*a*/6*b* by a piston 19 on a piston rod 21. As shown in FIG. 1, the hydraulic operator is mounted on the vehicle in the rod-up position when the tailgate is closed. The chamber 6*b* is in active fluid communication with the accumulator 9, and the chamber 6*a* is connected by the connecting line 23 to a cross connection 25 between the pump unit 7, the on-off valve 11 and the pressure-limiting valve 17**.

In the "Up" position of the actuating means 13, the pump unit 7 does not deliver, but stands still. At the same time, the on-off valve 11 is switched to the open position. Consequently, the accumulator 9, under pressure, is capable of displacing the piston 19 in the direction of the diminishing working chamber **6*a*, whereupon the medium in the chamber 6*a*, as a rule an oily liquid, is able to escape through the connecting line 23, the cross connection 25 and the on-off valve 11 into a reservoir 27. At this point the piston rod 21** has come to rest with the tailgate of the vehicle at an opened position.

In the "stop" switch position of the control system, no medium is delivered by the pump unit 7 and the on-off valve 11 is in the closed position. Consequently, the two working chambers 6*a*, 6*b* are both closed off. The tailgate is then held fixed in the instantaneous position.

Upon a closing motion of the tailgate of the vehicle or the "Down" switch position of the actuating means 13, medium is delivered from the pump 7 to the working chamber 6*a* of the hydraulic cylinder 6. The on-off valve 11 is in the closed position. The quantity of medium delivered moves the piston in the direction of the working chamber 6*b*. The medium forced out of the working chamber 6*b* is received in the accumulator 9.

With an active control system, it may happen that the energy supply, in this case the pump drive, fails. In order to ensure opening of the tailgate even in this operating condition, the pressure-limiting valve 17 permits piston motion in the direction of the working chamber 6*a*. A manual opening force applied to the tailgate provides the necessary pressure increase in the control pressure on the event of failure of the power supply. Then the on-off valve, owing to spring loading (as indicated at 26), assumes the closed position, as shown in FIG. 2.

The possibility of closing the hydraulic operator 6 mechanically also exists. The piston 19 is forced into the working chamber 6*b,* and the medium found therein is forced into the accumulator 9. To keep a vacuum from being produced in the working chamber 6*a,* medium flows from the reservoir 27 through a check valve 29 via the cross connection 25 into the working chamber 6*a*.

The active control system additionally provides protection against pinching. Should it happen that, in the course of descent of the piston rod 21 as the tailgate closes, an object or fingers become pinched between the vehicle tailgate and the vehicle body, it must be presumed that the on-off valve 11 has assumed the closed position and the pump unit 7 is able to deliver fluid to the chamber 6*a*. A pinched object produces a restraining force on the piston, so that a pressure increase appears in the working chamber 6*a* due to the delivery of the pump unit 7 since, as already stated, the on-off valve 11 has assumed the closed position. An increased pressure likewise appears on the pressure-limiting valve 17, which switches the pressure-limiting valve 17 over to the open position. The pressure-limiting valve 17 is connected controlwise with the on-off valve 11, which is then switched over into the open position. The reference character S3 designates a control linkage between the between the pressure-limiting valve 17 and the on off valve 11, such as a limit switch, for example, that senses the switch position of the pressure-limiting valve and transmits this information to the on-off valve electrically, pneumatically or hydraulically as a control signal.

The preloaded medium in the accumulator 9 is capable of moving the piston rod 21 in the ascending direction, since the pump unit 7 easily pumps through the released on-off valve 11. The volume present in the working chamber 6*a* is forced by the pressure into the reservoir 27. In principle, the ascending motion of the tailgate is supported by the additional pneumatic spring 15, owing to which the manual force necessary in an emergency is distinctly reduced.

Figure 3:
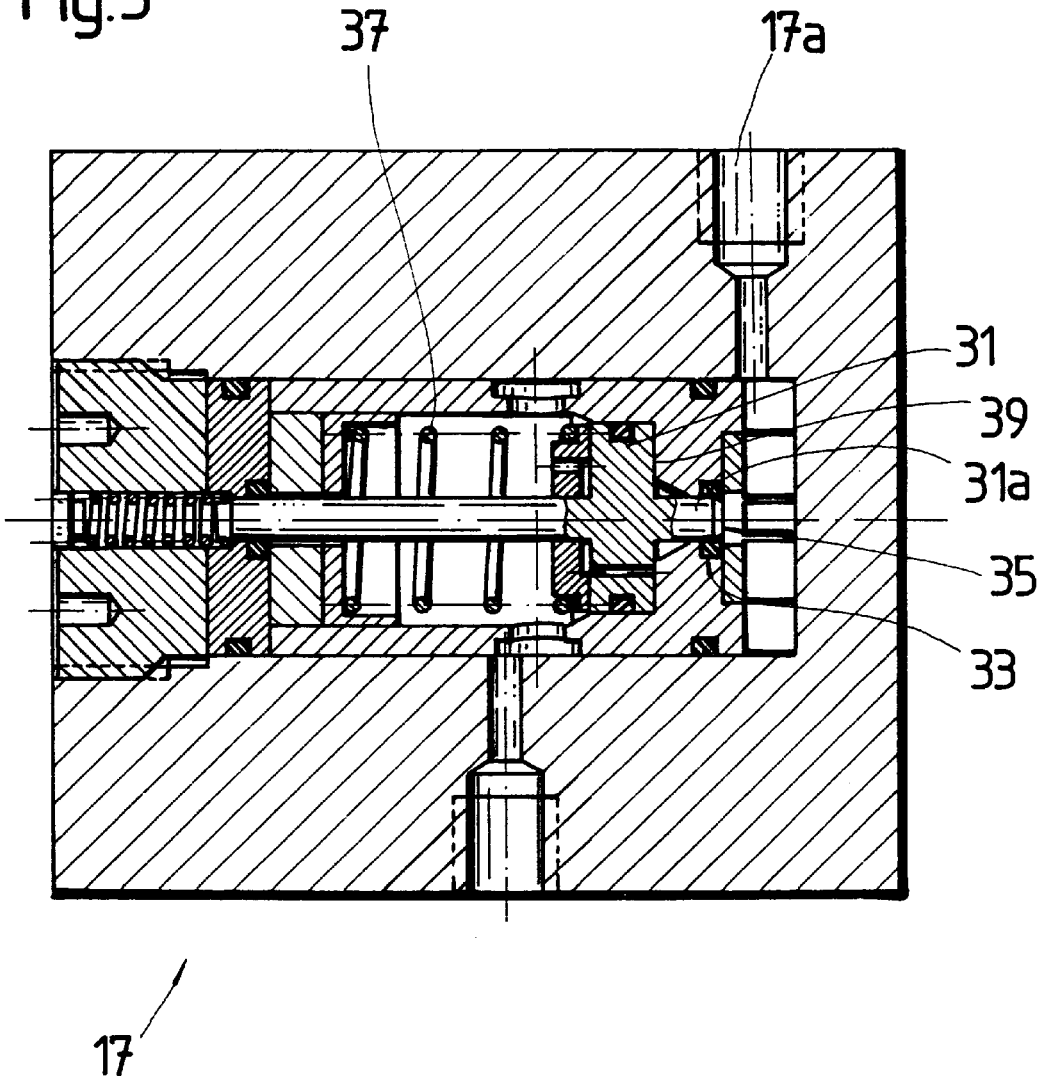
FIG. 3 is a sectional view through a preferred embodiment of a pressure-limiting valve.

A special feature of the pressure-limiting valve can be seen in FIG. 3. The pressure-limiting valve piston 31 is designed stepped. A pin extension 31*a,* sealed by an O-ring 33, represents a first small pressurized surface 35, which is constantly loaded by a combined control and operating pressure connection 17*a*. An adjustable preloading spring 37 represents a counterforce to the operating pressure or control pressure on the pressurized surface 35. If a greater opening pressure becomes effective, the pin extension 31*a* is displaced out of the O-ring 33. Axially behind the O-ring an enlarged pressure chamber with a greater second pressurized surface 39 is available on the pressure-limiting valve piston 31. The surface 39 is the annular surface that results from the difference between the areal content of the outside diameter of the piston and the areal content of the pressurized face 35 of the pin extension 31*a*.

This structural measure results in two points of operation for the pressure-limiting valve 17. If a first greater pressure threshold value is exceeded, the pressure-limiting valve opens by virtue of the pressure acting on the surface 35. In the open position, a distinctly smaller control pressure is necessary to hold the pressure-limiting valve in the open position, since the greater ring-shaped surface 39 is available as the pressurized surface against which the pressure acts. Specifically, in emergency operation this results in a distinct reduction of the force that must be exerted to move the piston rod in the ascending direction.

Although the invention has been described herein by reference to the foregoing preferred embodiment, it will be understood that such embodiment is susceptible of variation and modification without departing from the spirit and scope of the appended claims. Also, it will be understood that the invention may be applied to applications other than vehicular doors or tailgates.

What is claimed is:

1. An active control system for a movable member, comprising:

a piston-cylinder having a cylinder, a piston axially movable along the cylinder and forming in the cylinder a first chamber and a second chamber, and a piston rod connected to the piston;

a fluid pump;

a fluid reservoir for supplying fluid to the pump;

a first flow path for conducting fluid from the pump to the first chamber of the piston-cylinder to move the piston in one direction;

a second flow path including an on-off valve for conducting fluid from the first chamber to the reservoir, the on-off valve controlling the direction of axial movement of the piston; and a third fluid flow path including a pressure-limiting valve which, in emergency operation, opens a fluid connection between the first chamber of the piston-cylinder and the fluid reservoir to permit axial displacement of the piston in a direction opposite from said one direction, the pressure-limiting valve being connected to and being arranged to control the on-off valve, the on-off valve, in the event of overpressure in the piston-cylinder unit resulting from a movement of the piston rod in said one direction, switching to the open position, whereby the piston is free to move in the opposite direction, and the pressure-limiting valve including a pressure-limiting valve piston having two pressurized surfaces of unlike size, the two pressurized surfaces affording two pressure threshold values at which the valve piston is moved to and held at an open position, respectively.

2. The active control system of claim 1, and further comprising means for biasing the piston in said opposite direction.

3. The active control system of claim 1, wherein the piston-cylinder comprises a single-acting hydraulic cylinder.

4. The active control system of claim 1, and further comprising a fourth fluid flow path including a check valve for conducting fluid from the reservoir to the first working chamber of the piston-cylinder.

5. The active control system of claim 1, wherein a passive energy accumulator is connected in parallel with the active control system.

6. The active control system of claim 5, wherein the passive energy accumulator comprises a pneumatic spring.

* * * * *